US005576494A

United States Patent [19]

Osterberg

[11] Patent Number: 5,576,494

[45] Date of Patent: Nov. 19, 1996

[54] METHOD AND APPARATUS FOR SUBTERRANEAN LOAD-CELL TESTING

[76] Inventor: Jorj O. Osterberg, 16416 E. Powers Pl., Aurora, Colo. 80015

[21] Appl. No.: 451,661

[22] Filed: May 26, 1995

[51] Int. Cl.[6] ..... G01N 3/24

[52] U.S. Cl. ..... 73/784; 73/803; 73/816

[58] Field of Search ..... 73/84, 784, 803, 73/807, 816, 841, 845

[56] References Cited

U.S. PATENT DOCUMENTS

| | | | |
|---|---|---|---|
| 2,957,341 | 10/1960 | Menard | 73/84 |
| 3,574,284 | 4/1971 | Thordarson | 73/715 |
| 3,772,911 | 11/1973 | Ruppeneit et al. | 73/784 |
| 3,858,441 | 1/1975 | Comeau | 73/784 |
| 4,458,525 | 7/1984 | Lutenegger et al. | 73/84 |
| 4,483,197 | 11/1984 | Kellner | 73/784 |
| 4,598,591 | 7/1986 | Baud | 73/784 |
| 4,614,110 | 9/1986 | Osterberg | 73/84 |
| 4,662,213 | 5/1987 | Handy et al. | 73/37 |
| 4,663,977 | 5/1987 | Vander Heyden | 73/861.27 |
| 4,722,407 | 2/1988 | Gindy et al. | 177/50 |
| 5,259,240 | 11/1993 | Rains et al. | 73/84 |
| 5,319,959 | 6/1994 | Cooper et al. | 73/84 |
| 5,377,548 | 1/1995 | Ballivy | 73/768 |

FOREIGN PATENT DOCUMENTS

| | | | |
|---|---|---|---|
| 1413160 | 11/1975 | United Kingdom | 73/84 |

*Primary Examiner*—Michael Brock
*Attorney, Agent, or Firm*—John E. Reilly

[57] ABSTRACT

A method and apparatus for testing the load-bearing capacity of a subterranean formation surrounding a concrete shaft and is made up of an expansion chamber at the bottom of the hole containing the shaft and fluid pressure and return lines which extend downwardly into communication with spaced outer peripheral portions of the expansion chamber so that when fluid is pumped into the chamber any entrapped air can be removed through the return line, and when grout is subsequently pumped into the chamber any fluid can be displaced through the return line. Telltale measuring rods extend downwardly into contact with spaced outer peripheral portions of the expansion chamber to measure displacement of the chamber when pressurized fluid is delivered into the chamber. The method of testing may be applied also in cyclical loading of the formation beneath the shaft to simulate a support structure which undergoes large fluctuations in loading, for example, of the type induced by an earthquake.

20 Claims, 2 Drawing Sheets

METHOD AND APPARATUS FOR SUBTERRANEAN LOAD-CELL TESTING

BACKGROUND AND FIELD OF INVENTION

This invention relates to subterranean load-cell testing and more particularly relates to a novel and improved method and apparatus for measuring the load-bearing capacity of subterranean concrete shafts.

A previously devised method and apparatus for applying pressure and measuring upward and downward movements of the top and bottom of a load-testing device at the bottom of a concrete shaft is disclosed in my U.S. Pat. No. 4,614,110 entitled Device For Testing The Load-Bearing Capacity Of Concrete-Celled Earthen Shafts. Briefly, as set forth and described in my '110 patent, load-cell testing is carried out by placing an expansion device at the bottom of the concrete shaft and a pressurized fluid is pumped into the expansion device through a central pipe through which a telltale is inserted to measure the downward movement of the bottom of the expansion device. The telltale exits from the inside of the pressure pipe through a seal. Due to the long length of the pressure pipe, the pipe is shipped to the site in sections and must be welded in the field, and the welds must not leak under internal pressures to 8,000 psi. Once the testing has been completed, it is customary to fill the pipe and expansion device with grout by injection through the central pipe; however, it is very difficult to completely fill the pipe and expansion device without entrapping the pressurized fluid beneath the shaft.

It is therefore desirable to provide for an improved load-cell testing device of the type described which will prevent entrapment of the pressurized fluid as well as to avoid the necessity for a seal between the pipe and telltale or pressure welds in the field so as to achieve more accurate measurement of the load-bearing capacity of the shaft and assure complete filling of any voids in or beneath the shaft once the testing has been completed.

SUMMARY OF INVENTION

It is therefore an object of the present invention to provide for a novel and improved method and apparatus for testing both the end bearing and side shear resistance in a subsurface formation, particularly a subsurface formation surrounding a concrete shaft, and to be capable of filling any voids created by the test equipment in order to restore the test site to its original condition after the test is completed. The latter is of particular importance in tests performed on a working shaft in which the test equipment includes an expansion chamber at the bottom of the shaft. An important feature of the present invention is therefore to remove any entrapped fluid from the expansion chamber and completely fill it with grout so as to return the shaft to its original state.

Another object and important feature of the present invention is to provide for an improved delivery system both for pressurized fluid into an expansion chamber beneath a concrete shaft in testing the load capacity of the surrounding formation and wherein the delivery system as well as telltale measuring devices are removed from the center of the shaft and so located with respect to one another as to avoid the necessity of seals between the telltale equipment and delivery system and further eliminate the necessity of pressure welding of the delivery system in the field.

In accordance with the present invention, apparatus has been devised for measuring the load-bearing capacity of a concrete-filled subterranean shaft disposed in a hole wherein the fluid expansion member is disposed substantially flush with a bottom surface of a hole beneath the shaft, the expansion member being capable of undergoing vertically directed movement in response to fluid pressure applied thereto, the improvement comprising fluid pressure conduit means extending downwardly into the hole into communication with the expansion member for delivering fluid under pressure thereto, fluid return conduit means extending downwardly through the hole into communication with said expansion member for selectively removing fluid under pressure from the expansion member and including valve means for selectively opening and closing the fluid return conduit means, and means for delivering fluid under pressure to the fluid pressure conduit means and into the expansion chamber when the valve means is closed in order to impart upwardly and downwardly directed forces to a top and bottom of the expansion member.

Once testing is completed, grout is delivered under pressure through the fluid pressure conduit means into the expansion member until all of the pressurized fluid in the expansion member is displaced through the fluid return conduit means. To this end, the fluid pressure and fluid return conduit means are disposed in diametrically opposed relation to one another and in communication with outer peripheral portions of the expansion member. In addition, measuring means in the form of telltale rods are disposed for extension from the surface along outer peripheral portions of the hole into contact with upper and lower portions of the expansion member to measure the extent of upward and downward movement. In the alternative, a rod may be interposed between relatively moving surfaces of the expansion member and a transducer employed to sense the distance of displacement of the expansion member when the pressurized fluid is applied thereto.

The method for testing load capacity of a subsurface earth formation surrounding a concrete shaft comprises the steps of drilling a hole into the formation, placing an expansion chamber against a bottom surface of the hole with a fluid delivery conduit extending from above the formation to an outer peripheral portion of the chamber and a return conduit extending from another peripheral portion of the chamber to a location above the formation, injecting concrete into the hole to form a concrete shaft overlying the expansion chamber, pumping pressurized fluid through the delivery conduit into the expansion chamber whereby to cause the chamber to expand in upward and downward directions, and measuring the upward and downward distances of movement of the expansion chamber. The method is further characterized by cyclical loading of the expansion chamber by successively pumping fluid into the chamber and releasing pressure over a series of increments until ultimate loading or failure occurs.

The above and other objects, advantages and features of the present invention will become more readily appreciated and understood from a consideration of the following detailed description of preferred and alternate forms of invention when taken together with the accompanying drawings, in which:

DETAILED DESCRIPTION OF THE PREFERRED EMBODIMENT

Figure 1:
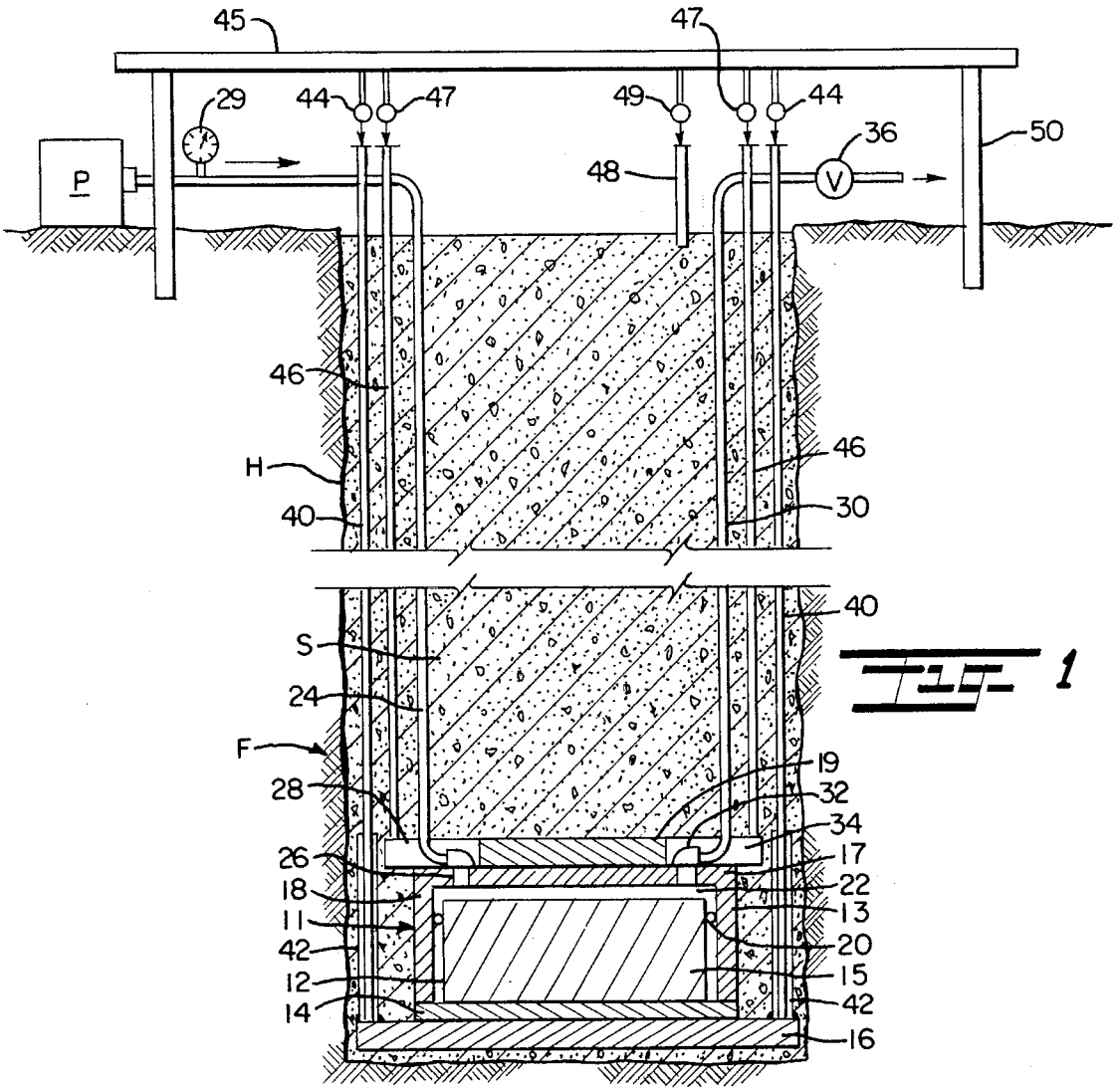
FIG. 1 is a longitudinal section view of one preferred embodiment of the test apparatus of the present invention installed in a working shaft in a subsurface formation.
Figure 2:
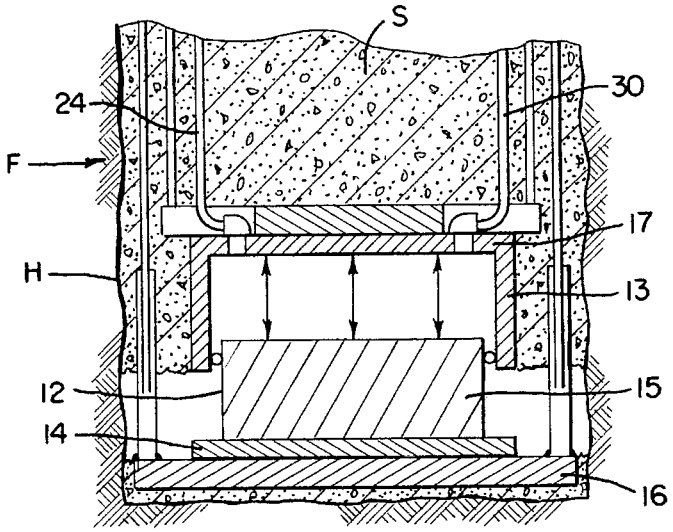
FIG. 2 is a somewhat fragmentary sectional view of the embodiment of FIG. 1 illustrating the application of pressurized fluid to an expansion chamber at the bottom of the working shaft.

Referring in more detail to the drawings, there is shown in FIGS. 1 and 2 a preferred form of load-cell testing apparatus for testing the load-bearing capacity of a subsurface formation generally designated at F in which a hole H is bored into the formation in a conventional manner and which is sized to receive a concrete shaft designated S. The shaft S is merely representative of various subsurface shafts or piers utilized, for example, as a foundation for bridges, buildings and the like and which must meet certain federal and state building codes for load-bearing capacities of subsurface structures. In order to carry out load-cell testing of the formation, the hole H is prepared such that the bottom is clean and flat so as to accommodate an expansion member in the form of a hydraulic jack 11, the latter being comprised of a cylindrical piston 12 disposed in sealed relation to a cylinder 13. The piston 12 includes a base plate 14 upon which is mounted a solid cylindrical body 15 of a diameter or slightly less than that of the base plate 14. The base plate 14 in turn is mounted on a larger platform or plate 16 which rests on the bottom of the hole and is sized to closely correspond to the diameter of the hole H. The cylinder 13 is in the form of an inverted end cap having a circular end plate 17 at its upper end, an outer surrounding side wall 18, and a top plate 19 is surmounted on the upper end plate 17. An annular seal 20 is interposed between the side wall 18 and body 15 so as to define a pressure chamber 22 therebetween.

In order to deliver hydraulic fluid under pressure into the chamber 22, a delivery hose 24 extends downwardly from a source of fluid under pressure at the surface and vertically along the outer peripheral edge of the hole H into communication with a hose fitting 26 which extends through the end plate 17 of the cylinder 13 and a recess 28 in the top plate 19. A suitable pressure gauge 29 is provided at the surface, and any suitable form of hydraulic pump P may serve as the pressurized fluid source. A return hose 30 extends upwardly from a second hose fitting 32 which extends through the end plate 17 from communication with the pressure chamber 22 and upwardly into a recess 34 which is preferably disposed in diametrically opposed relation to the hose fitting 26 in the top plate 19. Although the delivery and return hoses 24 and 30 are shown in diametrically opposed relation to one another extending vertically along the outer peripheral surface portions of the hole H it will be apparent that the hoses need not be located precisely in diametrically opposed relation to one another but merely disposed in circumferentially spaced relation to one another and both located toward the outer periphery of the pressure chamber 22 as well as the outer periphery of the hole H. The return hose 30 includes a suitable valve 36 at the surface.

In order to measure downward displacement of the expansion chamber 22, telltale rods 40 are slidable through sleeves 42 which are fixed in diametrically opposed relation to one another on the platform 16. Upward slidable movement of each rod 40 through the sleeve 42 in response to downward movement is measured by a digital displacement indicator 44 which is attached to a reference beam 45 extending horizontally across the shaft at the surface. One suitable form of indicator is Model No. DPX 1264, manufactured and sold by Chicago Dial Indicator Company of Des Plaines, Ill. Similarly, the upward movement of the top plate 19 is measured by telltale rods 46 having indicators 47 corresponding to those for the telltale rods 40 at the surface and which are attached to the common reference beam 45. Still another telltale rod 48 extends downwardly from the reference beam 45 into the concrete shaft S in order to measure the upward movement of the top of the concrete and includes an indicator 49 affixed to the reference beam 45.

From the foregoing, once the testing apparatus 10 is installed in an empty hole H, the hole H then can be partially or fully filled with concrete to the desired level for testing, and the reference beam 45 is provided with downwardly extending posts 50 which are driven into the formation at the surface surrounding the hole H. Water, oil or other pressurized fluid enters the pressure chamber 22 via the hose 24, the valve 36 on the return hose 30 being opened and the pressurized fluid being flushed through the chamber 22 in order to purge the system of air. Once the air is expelled, the valve 36 is closed and pressure is applied to the pressure chamber 22, the applied pressure being measured by the pressure gauge 29. The introduction of fluid under pressure into the chamber 22 causes equal upward and downward forces to be applied to the top of the cylinder 13 and upper end of the piston 12, respectively. The downward force is resisted by the subsurface formation at the bottom of the hole, hereinafter referred to as "end bearing". The upward force is resisted by the shear resistance between the concrete in the shaft and the subsurface formation along the interface between the concrete and peripheral surface of the hole, hereinafter referred to as "side shear". As the load increases, downward movement occurs due to the end bearing yielding, and upward movement of the concrete shaft occurs due to the side shear yielding along the interface. By measuring the upward and downward movements separately, separate upward and downward load-deflection curves can be drawn or recorded. Ultimate load or failure will occur either in side shear or end bearing when no further increase of load occurs with continued deflection. Again, the downward movement is measured by the telltale indicators 44, and the upward movement of the top plate 19 is measured by the telltale indicators 47. The difference in the average upward movement of the top plate 19 as measured by the indicators 47 and the upward movement of the top of the concrete as measured by the telltale indicators 49 is the elastic compression of the concrete shaft S above the top plate of the device. When the testing is completed and the concrete shaft S is to be used as part of the foundation for the finished structure, the valve 36 is opened and a high strength fluid grout, preferably consisting of cement, sand and water, is pumped into the pressure chamber 22 through the delivery hose 24 and out through the return hose 30 until all of the pressurized fluid is displaced and expelled from the system. The valve 36 is then closed and the grout allowed to harden and reach its designed strength. In certain applications it may be desirable to maintain a prestress in the concrete shaft S by holding a predetermined load to be maintained by the grout. In such case, the valve 36 is closed and the grout is held at a predetermined pressure level until it has reached its designed strength.

Figure 3:
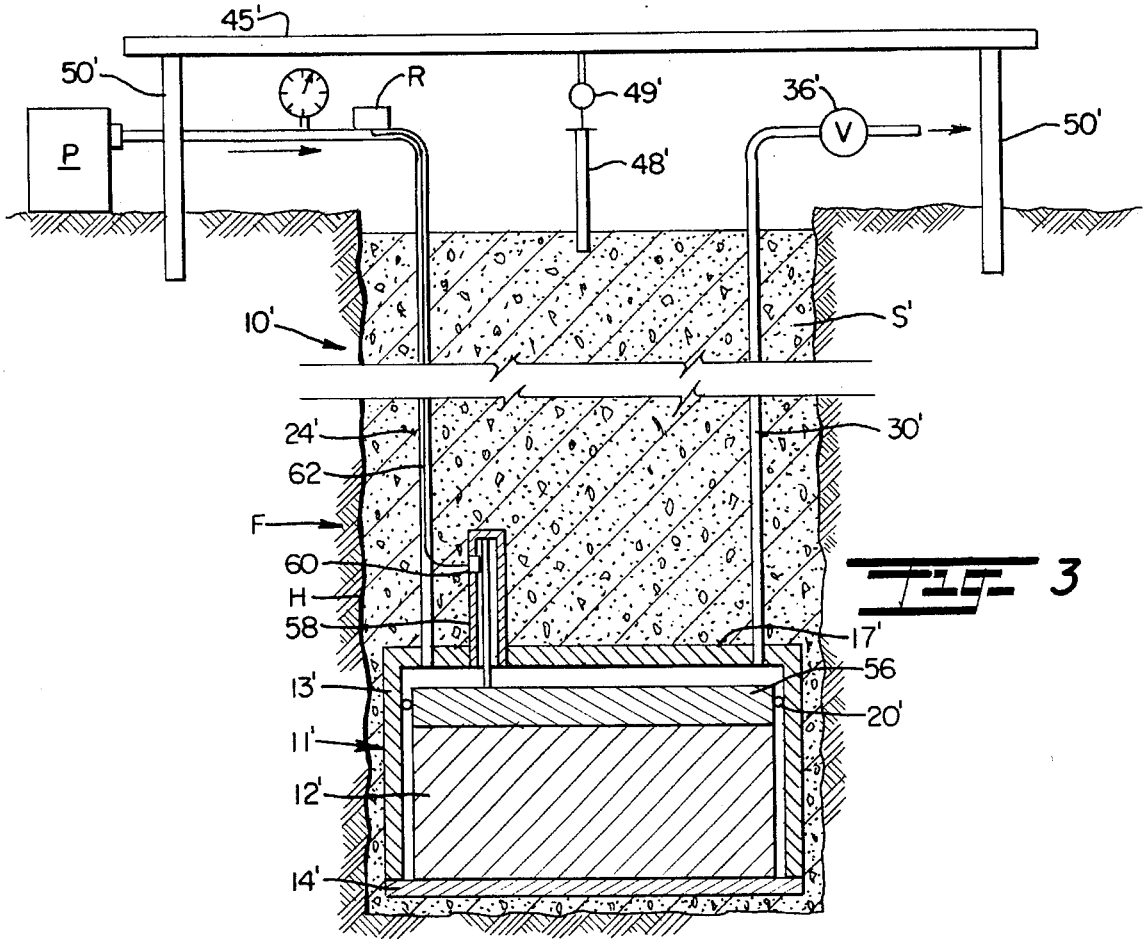
FIG. 3 is another longitudinal section view of an alternate embodiment of the present invention incorporating a modified form of telltale device to that of FIGS. 1 and 2.
Figure 4:
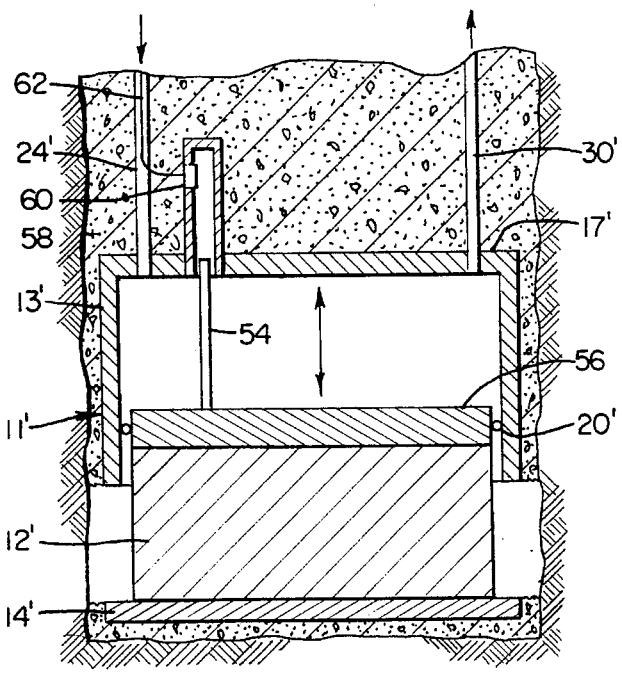
FIG. 4 is a fragmentary view of the alternate form shown in FIG. 3 illustrating the expansion chamber at the bottom of the shaft in an expanded condition.

A modified form of load cell testing apparatus 10' is illustrated in FIGS. 3 and 4 wherein like parts are correspondingly enumerated to those of FIGS. 1 and 2. Accordingly, the pressure chamber 22' corresponds to that of FIGS. 1 and 2 but eliminates the bottom platform 16 and top plate 19, the hoses 24' and 30' communicating directly with the pressure chamber 22' through the end plate 17' of the cylinder 13'. The principal modification in the form of FIGS. 3 and 4 resides in the utilization of an electronic sensing member having a rod 54 affixed to an upper plate 56 of the piston 12' and being slidable through a sleeve 58 in the end plate 17'. A linear variable differential transducer 60 is mounted in the sleeve 56 with a connecting wire 62 extending upwardly through the delivery hose 24' from the sleeve 56 and connected to a suitable recorder R at the surface. Displacement of the cylinder 13' away from the piston 12' when pressurized fluid is pumped into the chamber 22' will be sensed by the transducer 62 to provide a measurement of the change of distance between the end plate 17' and the upper plate 56 of the piston 12'. Displacement of the concrete shaft S' in response to applied pressure is once again sensed by a telltale indicator 49' connected to the rod 48' at the surface. Thus, FIG. 3 illustrates the testing device in its contracted position prior to introduction of pressure, and FIG. 4 illustrates the apparatus 10' after application of pressure and expansion of the cylinder 13' away from the piston 12'.

Customarily, the pressure chamber 22' will be capable of undergoing a displacement on the order of 6 inches depending upon the characteristics of the subsurface formation; and, by subtracting the upward movement of the shaft S' from the change in distance between the top and bottom of the cylinder 13' and piston 12' respectively, the downward movement of the This bottom of the piston 12' can be determined assumes that the concrete in the shaft is incompressible in comparison with the movements which occur due to side shear and end bearing. Although small, a reasonable estimate of the compression of the concrete in the shaft above the load cell can be determined by calculating the compression and knowing the force applied and modules of elasticity of the concrete or reinforced concrete, as the case may be. For the purpose of illustration but not limitation, one suitable form of commercially available transducer 60 is a Model No. 4450 Geokon Vibrating Wire Displacement Wire Transducer manufactured and sold by Geokon, Inc. of Lebanon, N.H. Further, it will be evident that the movements of the telltales of FIGS. 1 and 2 or FIGS. 3 and 4 can be sensed and converted into digital readings, from which the load-deflection curves can be plotted automatically.

Both in the preferred and modified forms of invention of FIGS. 1 to 4, the applied pressure may be gradually increased up to the maximum permissible pressure until ultimate load or failure occurs either in side shear or end bearing such that there is no further increase in load with continued deflection or expansion. An additional feature resides in the ability to cyclically load the test cell; or, in other words to load at any rate up to the capacity rate of the system either until the ultimate loading occurs, or by applying load cycles in preset load and time increments until the ultimate load is reached. Cyclical loading in the manner described may be applicable for testing any drilled shaft foundation which is subjected to cyclic load while in service including earthquake loading.

For the purpose of illustration, cyclic loading may be employed in a series of increments in which, for example, pressurized fluid is delivered via hose 24 or 24' into the expansion chamber 22 or 22' over an extremely short time interval on the order of several seconds for each increment. The valve 36 or 36' on the return conduit 30 or 30' is then instantaneously opened to cause the pressure to be released to zero or a minimum load then immediately closed and the next incremental pressure or loading applied by the pump to a higher pressure level, followed by immediately releasing to zero, and successively pumping and releasing in a repetitive manner until ultimate loading or failure occurs. After each cycle or increment there is some residual settlement of the concrete shaft and expansion chamber when the load is released to zero; and, after each cycle, the settlement increases until at some increment the settlement will increase without any or very little increase in load.

The type of cyclic loading described is used when the expected load on the shaft due to the supporting structure undergoes large fluctuations. In testing, most desirably the loads are applied rapidly at estimated speeds of only a few seconds for each load cycle and such testing may therefore be automated utilizing any suitable form of electronic sensing control circuitry or computer programming to successively activate the pump for the delivery conduit 24 or 24' and the value 36 or 36' for the return conduit 30 or 30'.

It is therefore to be understood that while preferred and alternate forms of invention have been herein set forth and described, various modifications and changes may be made therein without departing from the spirit and scope of the invention as defined by the following claims and reasonable equivalents thereof.

I claim:

1. Apparatus for measuring the load-bearing capacity of a concrete-filled subterranean shaft disposed in a hole wherein a fluid expansion member is disposed in proximity to a bottom surface of the hole beneath said shaft, said fluid expansion member being capable of undergoing vertically directed movement in response to fluid pressure applied thereto, the improvement comprising:

fluid pressure conduit means extending downwardly into the hole into communication with said expansion member for delivering fluid under pressure into said expansion member;

fluid return conduit means extending downwardly into the hole into communication with said expansion member for selectively removing fluid under pressure from said expansion member;

valve means associated with said fluid return conduit means for selectively opening and closing said fluid return conduit means; and means for delivering fluid under pressure to said fluid pressure conduit means into said expansion member when said valve means for said fluid return conduit means is closed whereby to impart upwardly and downwardly directed forces to a top and bottom of said expansion member.

2. Apparatus according to claim 1, wherein means are provided for delivering grout under pressure through said fluid pressure conduit means into said expansion member until all of said fluid in said expansion member is displaced through said fluid return conduit means.

3. Apparatus according to claim 1, wherein means are provided for measuring upward movement of said expansion member.

4. Apparatus according to claim 1, wherein means are provided for measuring downward movement of said expansion member.

5. Apparatus according to claim 1, wherein means are provided for measuring upward and downward movement of said expansion member.

6. Apparatus according to claim 5, wherein means are provided for measuring upward movement of a top surface of said concrete shaft.

7. Apparatus for measuring the load bearing capacity of a subsurface formation wherein a concrete shaft is disposed in a hole in said formation and a fluid expansion chamber is disposed beneath said shaft, said expansion chamber being capable of undergoing upward and downward movement in response to pressurized fluid being applied thereto, the improvement comprising:

fluid pressure conduit means extending downwardly through said hole into communication with a first outer peripheral portion of said expansion chamber for delivering fluid under pressure into said chamber;

fluid return conduit means extending downwardly through said hole into communication with an outer peripheral portion of said expansion chamber which is circumferentially spaced from said first outer peripheral portion for selectively removing the pressurized fluid from said expansion chamber;

valve means being associated with said fluid return conduit means for selectively opening and closing said fluid return conduit means;

means for delivering fluid under pressure through said fluid pressure conduit means into said expansion chamber when said valve means is closed whereby to impart upwardly and downwardly directed forces to said concrete shaft and bottom of said hole; and means for measuring upward and downward movement of said expansion chamber.

8. Apparatus according to claim 7, wherein said conduits are disposed in substantially diametrically opposed relation to one another and extend along outer peripheral portions of said hole into communication with outer peripheral portions of said expansion chamber.

9. Apparatus according to claim 7, said measuring means including an extension rod extending downwardly through said hole into contact with a top surface of said expansion member, and a sleeve disposed in surrounding relation to a lower portion of said rod.

10. Apparatus according to claim 7, wherein said expansion chamber includes a lower piston member and an upper cylinder overlying said piston member, and said measuring means includes a vertically extending sleeve on said cylinder and a telltale rod extending upwardly from said piston for vertical movement through said sleeve, and means for sensing the distance of vertical movement of said rod with respect to said sleeve.

11. Apparatus according to claim 10, wherein said sensing means includes a transducer mounted on said sleeve, and a recorder electrically connected to said transducer for indicating relative vertical movement between said rod and said sleeve.

12. The method for testing load capacity of a subsurface earth formation surrounding a concrete shaft comprising the steps of:

(a) drilling a hole into said formation;

(b) placing an expansion chamber against a bottom surface of said hole with a pressurized fluid delivery conduit extending from above said formation to an outer peripheral portion of said chamber and a return conduit extending from another peripheral portion of said chamber to a location above said formation;

(c) injecting concrete into said hole to form a concrete shaft overlying said expansion chamber;

(d) pumping pressurized fluid through said delivery conduit into said expansion chamber whereby to cause said chamber to expand in vertically directed upward and downward directions; and (e) measuring upward and downward distance of movement of said expansion chamber.

13. The method according to claim 12, wherein said pressurized fluid is a hydraulic fluid which is pumped into said expansion chamber until failure occurs either in side shear or in end bearing, followed by pumping grout through said delivery conduit into said expansion chamber and expelling any hydraulic fluid in said expansion chamber through said return conduit.

14. The method according to claim 12, wherein step (e) is characterized by extending a first rod downwardly through said hole to the bottom of said expansion chamber and a second rod downwardly through said hole to the top of said expansion chamber.

15. The method according to claim 14, wherein a pair of first rods are extended downwardly through said hole in diametrically opposed relation to one another to the bottom of said expansion chamber and a pair of second rods are extended downwardly through said hole in diametrically opposed relation to one another to the top of said expansion chamber.

16. The method according to claim 13, wherein said delivery conduit and said return conduit communicate with said expansion chamber at diametrically opposed locations.

17. The method according to claim 12, wherein said return conduit is selectively closed when pressurized fluid is pumped through said delivery conduit to said expansion chamber and said return conduit is selectively opened when grout is pumped through said delivery conduit into said expansion chamber.

18. The method according to claim 12, further characterized in step (d) by successively pumping pressurized fluid through said delivery conduit into said expansion chamber followed by releasing pressure from said fluid.

19. The method according to claim 18, characterized by pumping the pressurized fluid under progressively increased pressure during each pumping interval until ultimate loading occurs.

20. The method according to claim 18, wherein pressure is released between each pumping interval by opening said return conduit.

* * * * *